United States Patent [19]

Takauji et al.

[11] Patent Number: 4,700,603

[45] Date of Patent: Oct. 20, 1987

[54] FORMANT FILTER GENERATOR FOR AN ELECTRONIC MUSICAL INSTRUMENT

[75] Inventors: Kiyomi Takauji; Tatsunori Kondo, both of Shizuoka, Japan

[73] Assignee: Kabushiki Kaisha Kawai Gakki Seisakusho, Japan

[21] Appl. No.: 847,426

[22] Filed: Apr. 2, 1986

[30] Foreign Application Priority Data

Apr. 8, 1985 [JP] Japan ..... 60-073700

[51] Int. Cl.[4] ..... G10H 1/12; G10H 7/00

[52] U.S. Cl. ..... 84/1.19; 84/1.23; 84/DIG. 9; 364/419; 364/724

[58] Field of Search ..... 84/1.11–1.13, 84/1.19–1.27, DIG. 9; 364/419, 724

[56] References Cited

U.S. PATENT DOCUMENTS 4,548,119 10/1985 Wachi et al. ..... 84/1.19

4,554,858 11/1985 Wachi et al. ..... 84/1.19

*Primary Examiner*—S. J. Witkowski

*Attorney, Agent, or Firm*—McGlew and Tuttle

[57] ABSTRACT

In the production of a desired musical waveform by combining harmonic components corresponding to respective harmonic orders, the cut-off harmonic order $q_c$, each harmonic component value is controlled by selecting the level Ha and the slope of the Formant filter characteristic. The cut-off harmonic order $q_c$, the level Ha and the slope value can each be varied over a predetermined range. These operations can be performed with a simple circuit arrangement involving a small number of memories. Therefore, the present invention greatly contributes to the reduction of the size and the cost of electronic musical instruments.

9 Claims, 39 Drawing Figures

FORMANT FILTER GENERATOR FOR AN ELECTRONIC MUSICAL INSTRUMENT

BACKGROUND OF THE INVENTION

1. Field of the Invention

The present invention relates to an electronic musical instrument which creates a desired musical waveform through Fourier synthesis on the basis of harmonic coefficients, and more particularly to an electronic musical instrument which is provided with a harmonic coefficient control means.

2. Description of the Prior Art

Heretofore there have been proposed, for controlling harmonic coefficients through utilization of Formant filter characteristics in an electronic musical instrument, a method which employs memories for storing all the Formant filter characteristics, a method which obtains a desired Formant filter characteristic through calculations, and various other methods.

The method which stores all the Formant filter characteristics necessistates the use of a huge number of memories for producing a variety of desired musical tones. At present, memories are low-cost; however, a system with plenty of memories will inevitably increase the manufacturing costs of electronic musical instruments. On the other hand, the method which obtains the desired Formant filter characteristic entirely through calculations needs many calculating means, that is, involves a lot of calculations, and hence calls for complicated circuit arrangements, leading to difficulties in fabrication as an integrated circuit.

SUMMARY OF THE INVENTION

It is therefore an object of the present invention to provide an electronic musical instrument which permits easy control of harmonic coefficients with a small number of memories and a simple circuit arrangement through the combined use of the above-mentioned conventional memory system and calculation system.

To attain the above object, the electronic musical instrument of the present invention, which is of the type that combines harmonic components into a desired musical waveform, is provided with a means for qenerating a cut-off harmonic order $q_c$ of a Formant filter characteristic, a means for generating a level Ha of the Formant filter characteristic, a means for storing a slope curve of the Formant filter characteristic, and a means for selecting the values of the level Ha from the level generating means and the slope curve from the storing means in accordance with the cut-off harmonic order $q_c$ from the cut-off harmonic order generating means. Each harmonic component value is controlled with the output signal of the selecting means.

With the above arrangement, it is possible to control each harmonic component value by selecting the values of the cut-off harmonic order $q_c$, the level Ha and the slope curve of the Formant filter characteristic for obtaining a desired musical waveform. The values of the cut-off harmonic order $q_c$, the level Ha and the slope curve can each be varied over a predetermined range. Besides, these operations can be performed with a small number of memories and a simple arrangement.

DESCRIPTION OF THE PREFERRED EMBODIMENTS

A description will be given first, with reference to FIG. 1, of the Fourier synthesis system that the present invention utilizes. It must be noted, however, that the present invention is not limited specifically thereto but will work well with all the Fourier synthesis systems based on harmonic coefficients.

Figure 1:
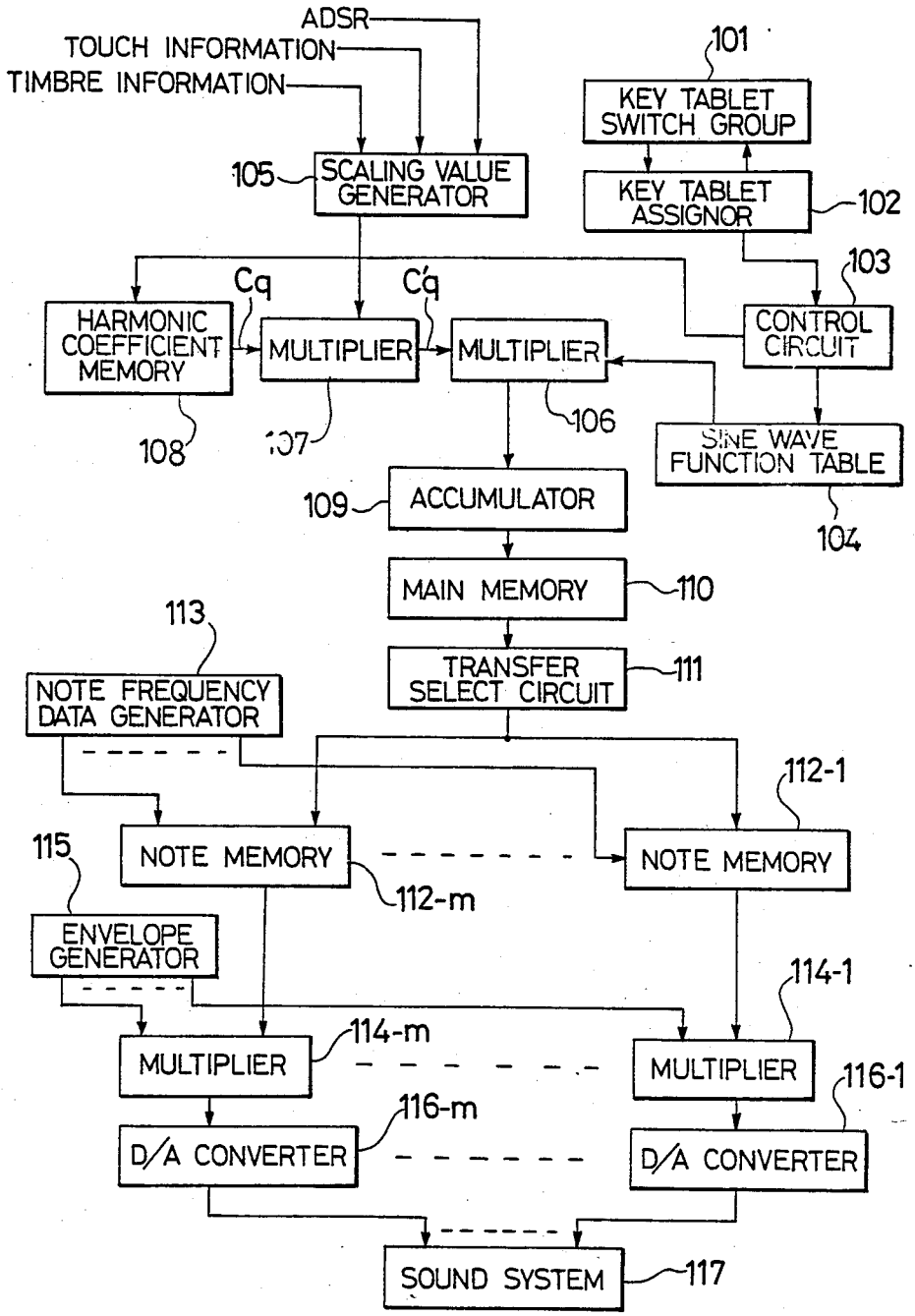
FIG. 1 is a block diagram illustrating the arrangement of an embodiment of the present invention.

FIG. 1 illustrates in block form an embodiment of the present invention in which a musical tone generating system produces a desired musical tone through an ordinary Fourier synthesis system.

A key tablet assignor 102 scans a key tablet switch group 101 to detect the ON/OFF state, touch response, or the like of key switches included in the group 101 and holds the information of the respective switches. The information is provided to a control circuit 103 which controls the musical tone generations system.

When supplied with the information from the key tablet assignor 102, the control circuit 103 sets a composite waveform in a main memory 110 on the basis of the following Fourier synthesis equation (1):

$$Zn = \sum_{q=1}^{W} Fq \cdot Cq \cdot \mathrm{SIN}\frac{2\pi nq}{2W}, n - 1 \text{ to } 2W \tag{1}$$

where q is the harmonic order, n the sample point number, W the number of harmonics, Cq a harmonic coefficient, Fq a scaling coefficient, and Zn a sample value. The procedure therefor is as follows: A signal is applied from the control circuit 103 to a harmonic coefficient memory 108 to read out therefrom the harmonic coefficient Cq of a timbre desired to produce. On the other hand, ADSR data which is envelope information representing temporal variations, touch information representing initial and after touch response data, and timbre information representing a selected timbre are applied to a scaling value generator 105, from which is obtained a scaling value Fq for scaling the harmonic coefficient Cq. The harmonic coefficient Cq and the scaling value Fq are multiplied in a multiplier 107, obtaining a harmonic coefficient Cq' scaled by the scaling value Fq. The harmonic coefficient Cq' thus obtained and a q-order sine wave value sin $\pi nq/w$ read out from a sine wave function table 104 with a signal from the control circuit 103 are multiplied in multiplier 106. The multiplied value from the multiplier 106 is accumulated by an accumulator 109, by which the composite waveform expressed by Eq. (1) is created in a main memory 110.

Next, the composite waveform thus stored in the main memory 110 is transferred via a transfer select circuit 111 to at least one of note memories **112-*l* to 112-*m* (where m means the provision of plural note memories, but it is evident that they can be combined into one on a time-shared basis) corresponding to keys. The composite waveform thus stored in the note memory is read out therefrom, without exerting any influence upon the synthesization of a waveform, by note frequency data from a note frequency data generator 113 which generates note frequency data corresponding to a depressed key. Data read out of the note frequency memories 112-*l* to 112-*m* corresponding to a scale is each multiplied, in one of multipliers 114-*l* to 114-*m*, by the envelope output waveform from an envelope generator 115 which creates an envelope waveform corresponding to each depressed key, thus producing musical waveform data added with an envelope. The musical waveform data from the multipliers 114-*l* to 114-*m* is converted by D/A converters 116-*l* to 116-*m* into an analog musical waveform, which is applied to a sound system 117**, creating a desired musical tone.

As described above, according to the present invention, the scaling value generator 105, which generates the scaling value Fq for scaling the harmonic coefficient Cq from the harmonic coefficient memory 108 by the multiplier 107, is formed by a means which produces a desired Formant filter characteristic through use of a small number of memories and a simple circuit arrangement.

Figure 2A:
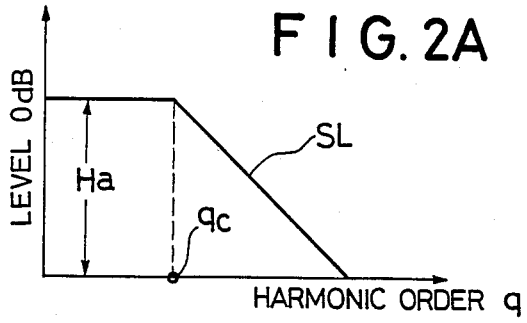
FIGS. 2A to 2D are graphs showing Formant filter characteristics in the present invention.

FIGS. 2A through 2D show four general patterns of the Formant filter characteristic which is the characteristic of the scaling value generator 105. FIG. 2A shows a low-pass filter characteristic with no resonance, FIG. 2B a high-pass filter characteristic with no resonance, FIG. 2C a low-pass filter characteristic with resonance, and FIG. 2D a high-pass filter characteristic with resonance. In FIG. 2A through 2D the abscissa represents the harmonic order and the ordinate the level value. The double circle indicates the cut-off order $q_c$ and the level Ha the level except in the case of a slope (SL).

Figure 2B:
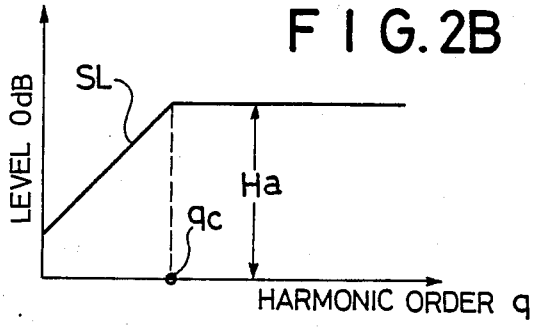
Figures 3A, 3B:
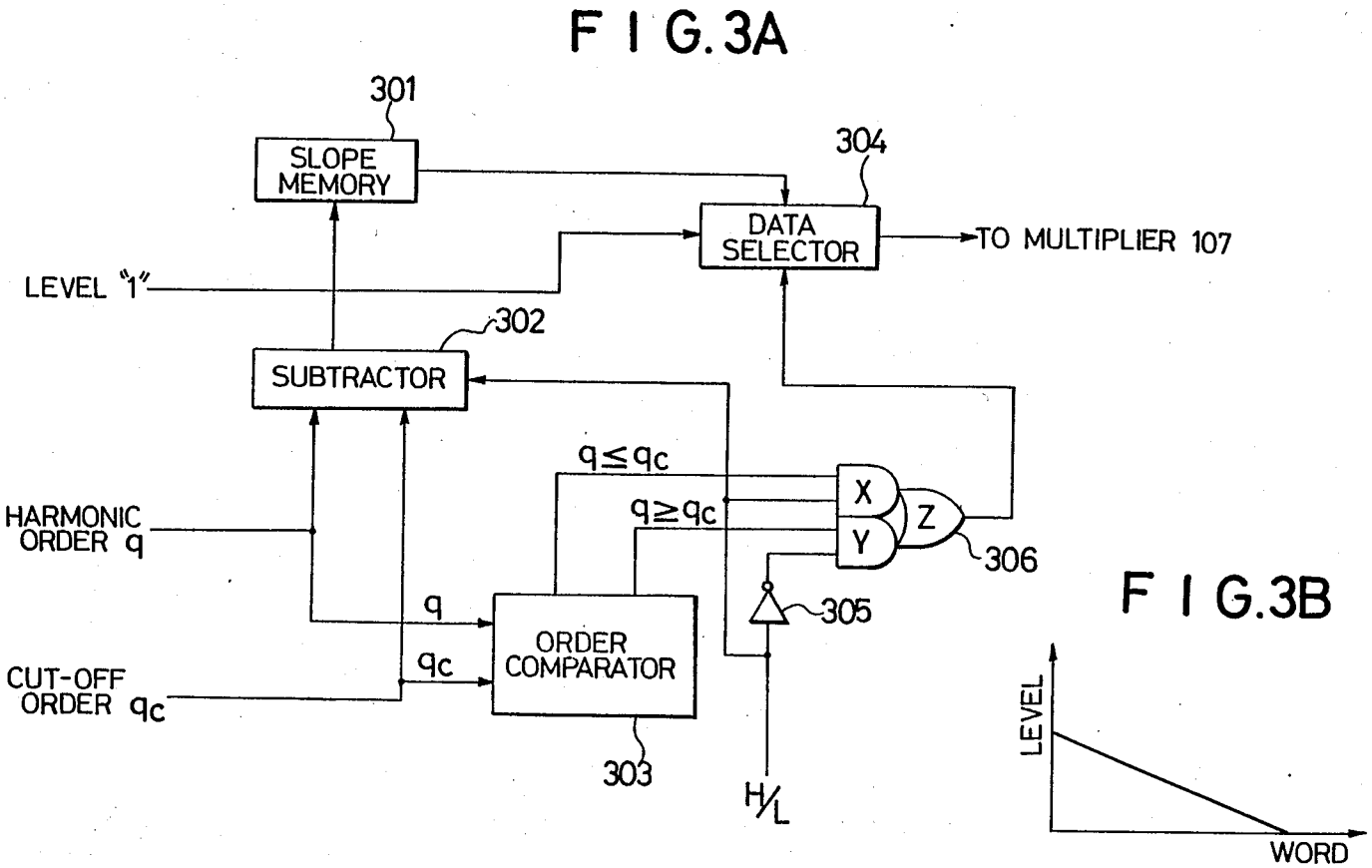
FIGS. 3A and 3B are diagrams for explaining a specific example of the production of a waveform according to the present invention.
Figure 4A:
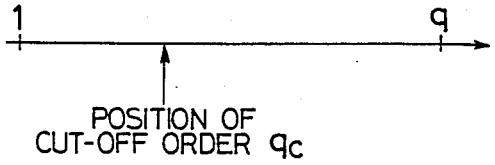
FIGS. 4A through 4G are diagrams for explaining the operation of the example depicted in FIG. 3A.
Figure 4B:
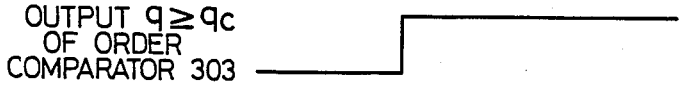
Figure 4C:
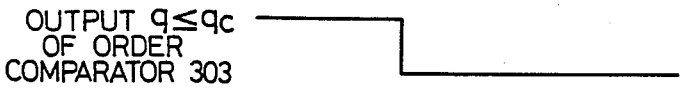
Figure 4D:
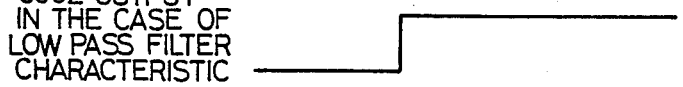
Figure 4E:
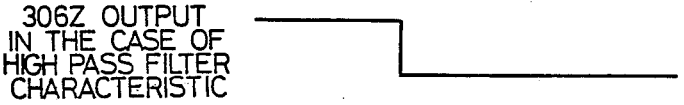

FIG. 3A illustrates in block form an arrangement for obtaining the Formant filter characteristics with no resonance depicted in FIGS. 2A and 2B. FIG. 3B is explanatory of the contents of a slope memory 301 used in the arrangement shown in FIG. 3A. FIGS. 4A through 4G are diagrams for explaining the operation of the circuit arrangement shown in FIG. 3A. The harmonic order q, which varies from 1 to q as shown in FIG. 4A, is applied to a subtractor 302 and an order comparator 303. The cut-off order $q_c$ is value which can freely be set within the range of $1 \leqq q_c \leqq q$, as depicted in FIG. 4A, and it is similarly provided to the subtractor 302 and the order comparator 303. The order comparator 303 compares the both inputs q and $q_c$ in magnitude and produces signals $q \geqq q_c$ and $q \leqq q_c$ such as shown in FIGS. 4B and 4C, each of which is provided to one of the inputs of each of AND gates Y and X of an AND-OR gate 306 (a gate in which the outputs of parallel-connected AND gates Y and X are connected to the inputs of an OR gate Z). The AND gate X of the AND-OR gate 306 is supplied at the other input with an H/L signal (which goes to "H" in the case of the high-pass filter characteristic and "L" in the case of the low-pass filter characteristic). The AND gate Y is supplied at the other input with a signal obtained by inverting the H/L signal with an inverter 305. As a result of this, the OR gate Z of the AND-OR gate 306 yields either one of signals shown in FIGS. 4D and 4E. The output of the AND-OR gate 306 is provided to a data selector 304 to cause it to select the output of the slope memory 301 or a level "1" (which means 0 dB) depending upon whether the output of the AND-OR gate 306 is "H" or "L". The subtractor 302 performs an operation $(q_c-q)$ or $(q-q_c)$ depending upon whether the H/L signal is "H" or "L", and provides the resulting output as an address signal for the slope memory 301. Table 1 shows, by way of example, variations of the address signal which is available from the subtractor 302 when q=1 to 16 and $q_c=5$.

TABLE 1

| q | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| $q_c - q$ | 4 | 3 | 2 | 1 | 0 | −1 | −2 | −3 | −4 | −5 | −6 | −7 | −8 | −9 | −10 | −11 |
| $q - q_c$ | −4 | −3 | −2 | −1 | 0 | 1 | 2 | 3 | 4 | 5 | 6 | 7 | 8 | 9 | 10 | 11 |
| $q \leqq q_c$ | 1 | 1 | 1 | 1 | 1 | 0 | 0 | 0 | 0 | 0 | 0 | 0 | 0 | 0 | 0 | 0 |
| $q \geqq q_c$ | 0 | 0 | 0 | 0 | 1 | 1 | 1 | 1 | 1 | 1 | 1 | 1 | 1 | 1 | 1 | 1 |

Figure 4F:
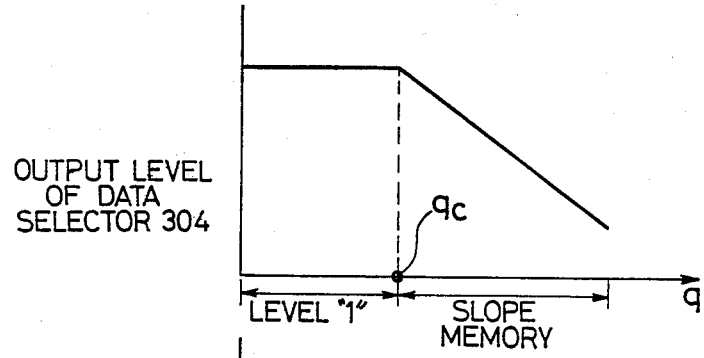
Figure 4G:
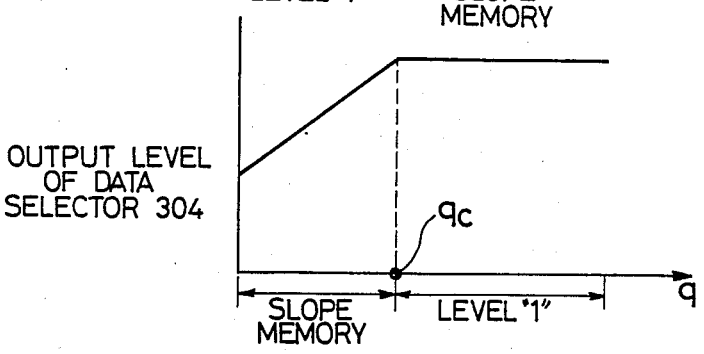

In the cases of minus values in Table 1, the output of the slope memory 301 will not be selected by the data selector 304; so that no problem will occur. Where the stored contents of the slope memory 301 bear such a word-level relationship as depicted in FIG. 3B, the data selector 304 will output, in the case of the low-pass filter characteristic, the level "1" until the harmonic order q reaches the cut-off order $q_c$ and thereafter the slope value stored in the slope memory 301, thus obtaining such a Formant filter characteristic as shown in FIG. 4F. On the other hand, in the case of the high-pass filter characteristic, the data selector 304 will select the slope value stored in the slope memory 301 until the harmonic order q reached the cut-off order $q_c$ and thereafter the level "1", providing such a Formant filter characteristic as shown in FIG. 4G. The Formant filter characteristic data thus obtained from the data selector 304 is used as a value for scaling the coefficient value Cq from the harmonic coefficient memory 108 by the multiplier 107, as indicated by the output Fq of the scaling value generator 105 in FIG. 1.

Figure 2C:
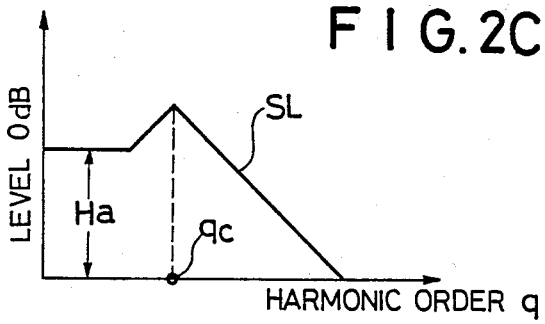
Figure 2D:
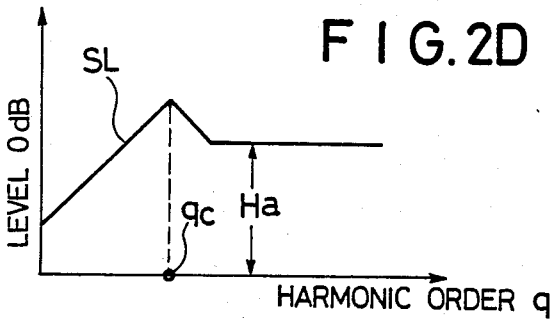
Figure 5:
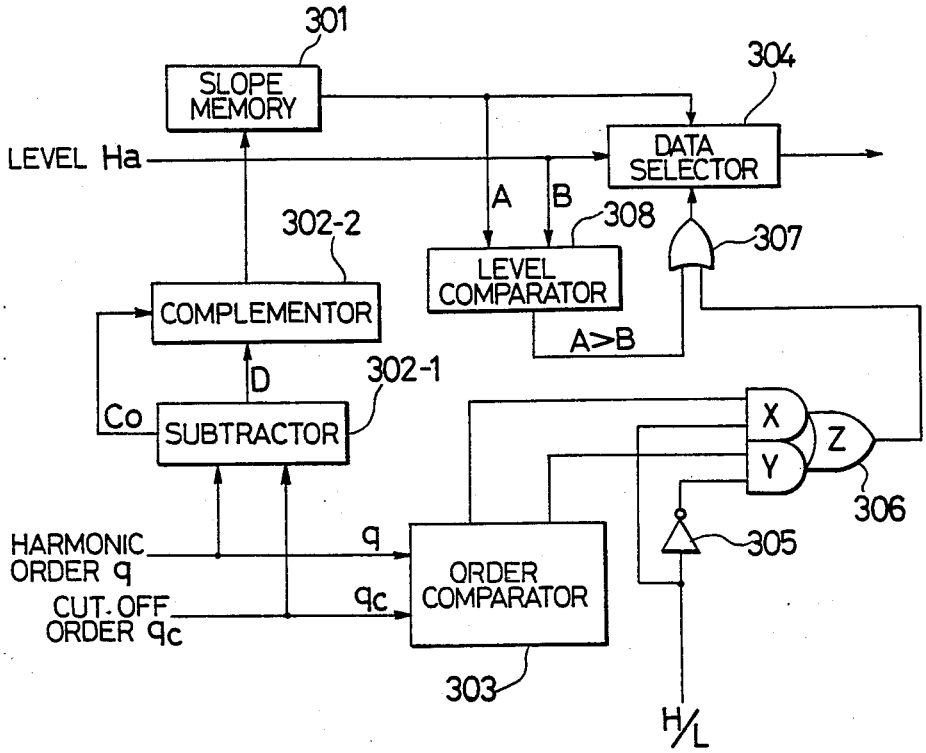
FIG. 5 is a block diagram illustrating another specific arrangement for the waveform production according to the present invention.

FIG. 5 illustrates in block form an arrangement with which it is possible to obtain not only the Formant filter characteristics shown in FIGS. 2A and 2B but also Formant filter characteristics with resonance such as depicted in FIGS. 2C and 2D. FIGS. 6A through 6G are diagrams for explaining the operation of the circuit arrangement depicted in FIG. 5.

Figure 6A:
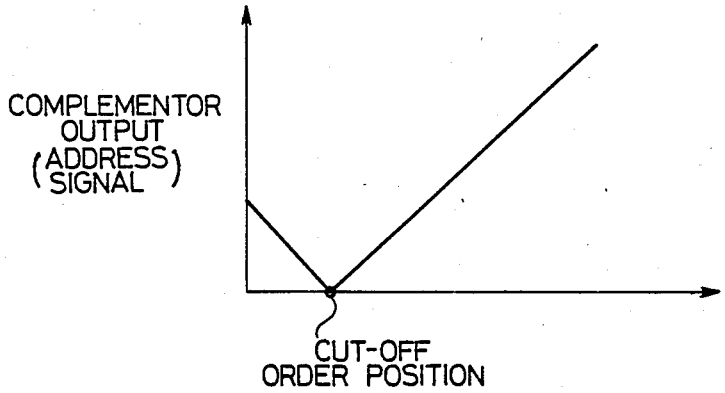
FIGS. 6A to 6G are graphs for explaining the operation of the example shown in FIG. 5.
Figure 6B:
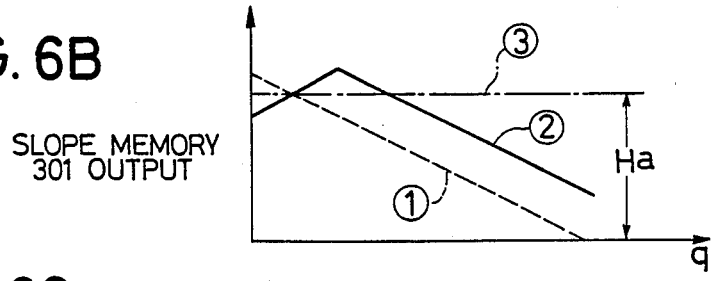
Figure 6C:
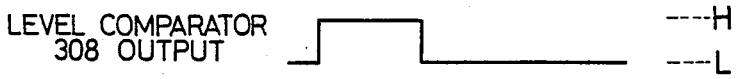

In FIG. 5 the blocks corresponding to those in FIG. 3A are identified by the same reference numerals and no detailed description will be given of them. A subtractor 302-1 performs an operation $(q-q_c)$ and applies its output D to a complementor 302-2. The complementor 302-2 further receives, as a control input, an overflow signal Co from the subtractor 302-1 and converts the subtractor output D into an absolute value |D|, which will be used as an address signal for accessing the slope memory 301. This is shown in FIG. 6A. Assuming that the broken line (1) in FIG. 6B indicates the stored contents of the slope memory 301, the line (2) in FIG. 6B will represent the value which is read out of the slope memory 301, using the output of the complementor 302-2 as an address signal. A level comparator 308 makes a comparison between the value read out of the slope memory 301 [ indicated by the line (2) in FIG. 6B] and the freely settable level Ha [ indicated by the one-dot chain line (3) in FIG. 6B], and yields a high- or low-level signal depending upon whether the output signal of the slope memory 301 is higher than the level Ha or not, as shown in FIG. 6C. The output of the level comparator 308 is provided to the one input of an OR gate 307. The other input of the OR gate 307 is supplied with the output from the AND-OR gate 306 which yields the same signals as those described previously with regard to FIGS. 3A and 3B.

Figure 6D:
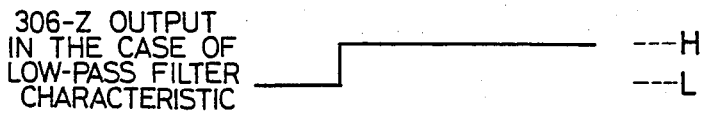
Figure 6E:
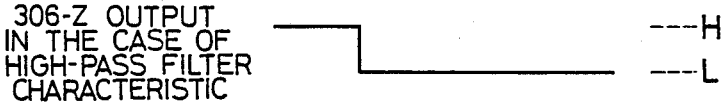
Figure 6F:
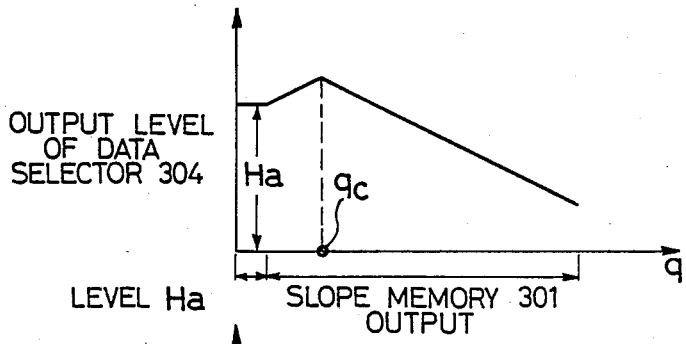
Figure 6G:
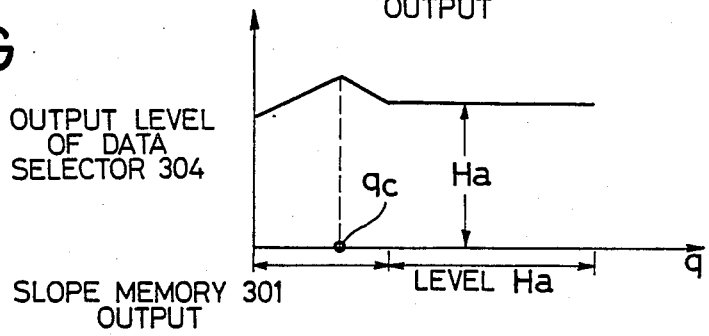

In this instance, the AND-OR gate 306 outputs such a signal as shown in FIG. 6D in the case of the low-pass filter characteristic and such a signal as shown in FIG. 6E in the case of the high-pass filter characteristic. Depending upon whether the output signal from the OR gate 307 is high ("H") or low ("L"), the data selector 304 selects the value read out of the slope memory 301 or the freely settable level Ha. In consequence, the data selector 304 yields such a Formant filter characteristic curve as shown in FIG. 6F in the case of the low-pass filter characteristic and such a Formant filter characteristic curve as shown in FIG. 6G in the case of the high-pass filter characteristic. The output of the data selector 304 is applied to the multiplier 107, wherein it is used for scaling the coefficient Cq available from the harmonic coefficient memory 108, as indicated by the output Fq of the scaling value generator 105.

Figure 7:
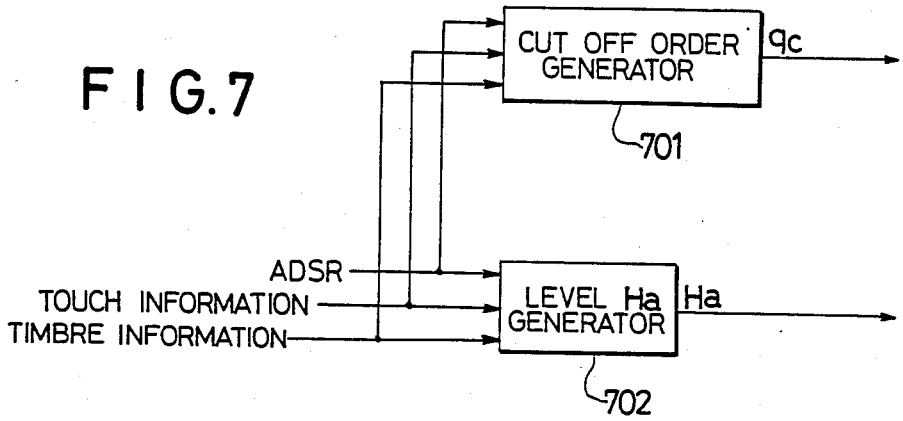
FIG. 7 a diagram illustrating a specific example of the arrangement for a waveform variation.
Figure 8A:
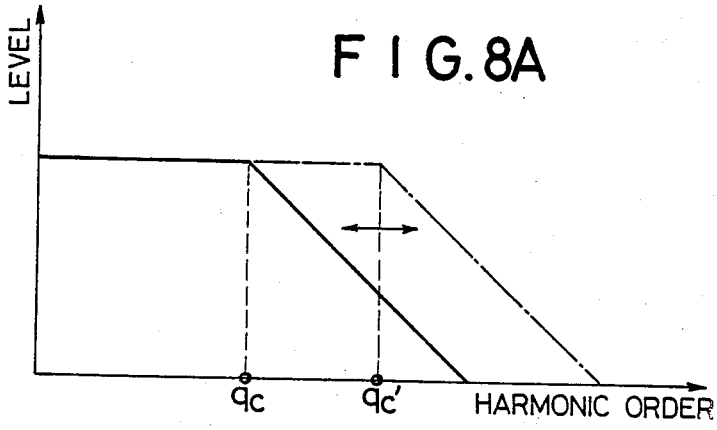
FIGS. 8A and 8B are graphs for explaining the operation of the example depicted in FIG. 7.
Figure 8B:
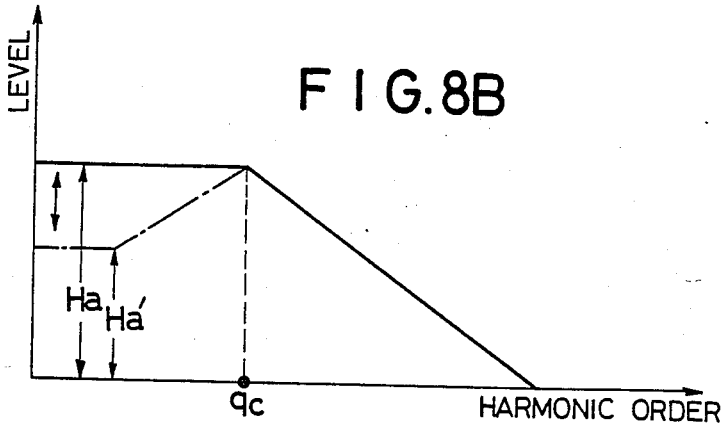

FIG. 7 illustrates, by way of example, an arrangement by which the cut-off order $q_c$ and the level Ha can be varied in accordance with the ADSR, touch and timbre information. FIGS. 8A and 8B are graphs for explaining it. By varying the output of a cut-off order generator 701 from $q_c$ to $q_c'$, the slope of the Formant filter characteristic will vary from the full line corresponding to the cut-off order $q_c$ to the one-dot chain line corresponding to the cut-off order $q_c'$, as depicted in FIG. 8A. Furthermore, by varying the output of a level Ha generator 702 from Ha to Ha', there will be obtained such a Formant filter characteristic as shown in FIG. 8B in which the relative resonance varies from the full line corresponding to the level Ha to the one-dot chain line corresponding to the level Ha'. In this way, the Formant filter characteristic can easily be varied by changing the cut-off order $q_c$ and the level Ha with various information.

Figure 9:
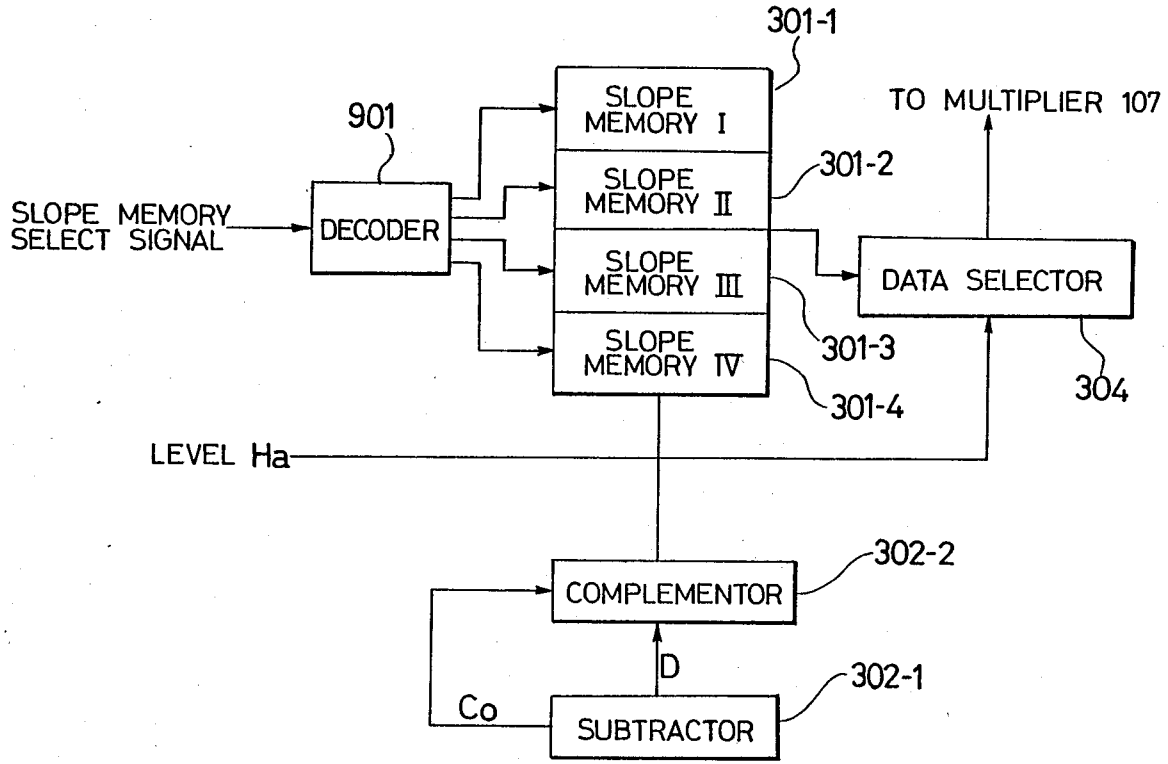
FIGS. 9, 11, and 13 are block diagrams respectively illustrating other specific examples of the arrangement for waveform variations according to the present invention.
Figure 10A:
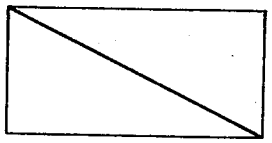
FIGS. 10A to 10H, 12A and 12B, and 14 are graphs for explaining the operations of the examples shown in FIGS. 9, 11, and 13, respectively.
Figure 10B:
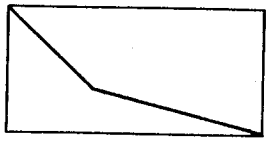
Figure 10C:
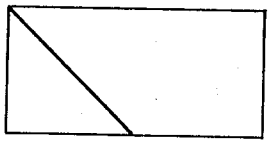
Figure 10D:
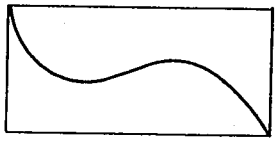
Figure 10E:
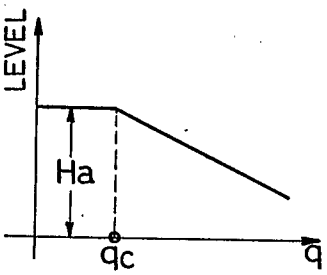
Figure 10F:
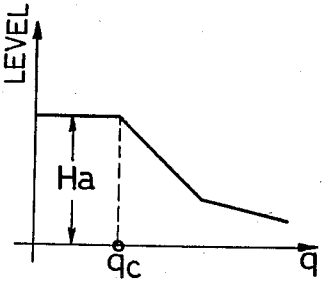
Figure 10G:
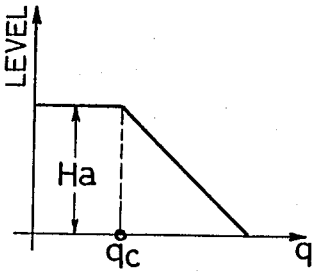
Figure 10H:
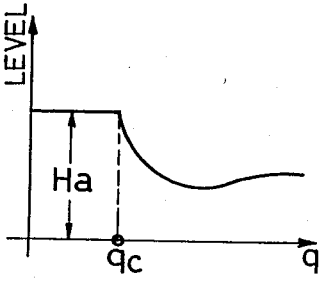

FIG. 9 is a block diagram illustrating a modified form of the circuit arrangement shown in FIG. 5, in which four slope memories (I) to (IV) 301-1 to 301-4 are provided. FIGS. 10A through 10H are explanatory diagrams. In this instance, a slope memory select signal is applied to a decoder 901, which is turn selects that one of the slope memories 301-1 to 301-4 corresponding to the slope memory select signal, and the output of the selected slope memory is provided to the data selector 304. Also in FIG. 9, the blocks identified by the same reference numerals as those in the figures previously referred to possess the same functions. FIGS. 10A to 10D respectively show the stored contents of the slope memories I to IV (301-1 to 301-4) and FIGS. 10E to 10H corresponding data from the data selector 304. FIGS. 10E to 10H show the data, setting the level Ha to "1", i.e. 0 dB and the cut-off order $q_c$ to a desired value on the harmonic order axis. Also by an arbitrary modification or selection of the contents of the slope memory as described above, desired various Formant filter characteristics can be obtained.

Figure 11:
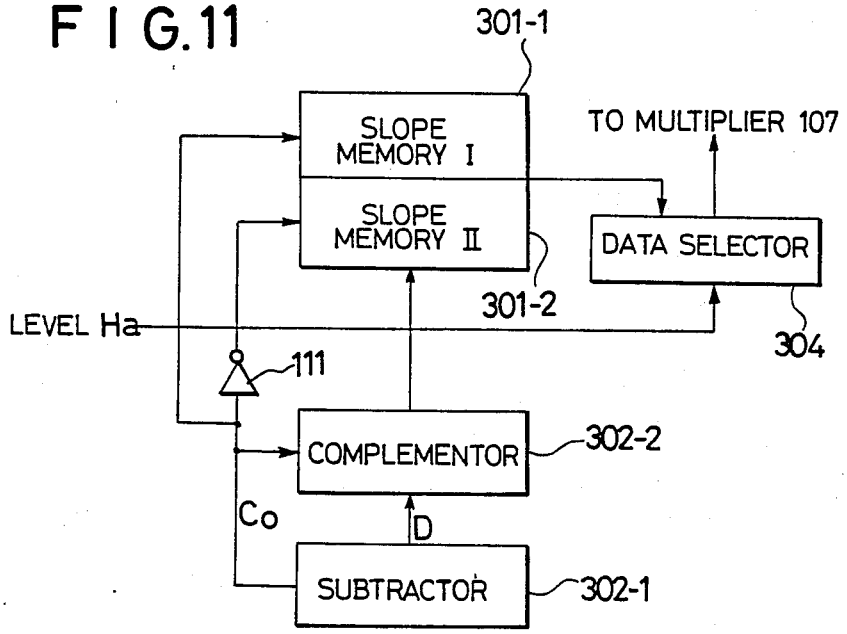
Figure 12B:
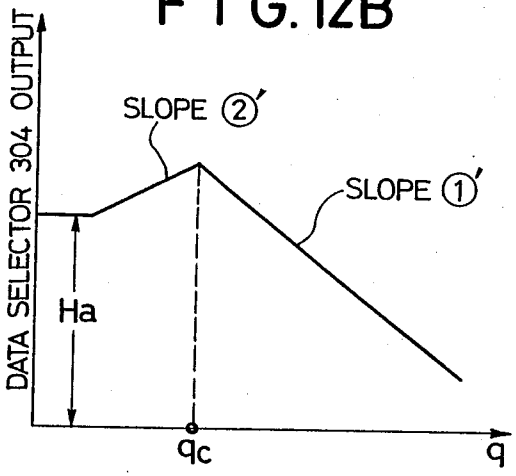
Figure 12A:
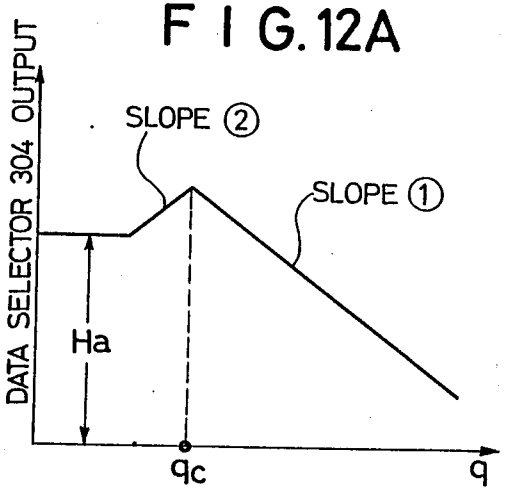

FIG. 11 illustrates a circuit arrangement by which the Formant filter characteristic with resonance has different slopes on the left and right of the cut-off order $q_c$. As described previously in connection with FIG. 5, the contents of the slope memory 301 are read out by the address signal from the complementor 302-2 and the read-out output is used for defining the slope of the Formant filter characteristic. FIG. 12A shows the Formant filter characteristic obtained when one slope memory is used, that is, through use of the system depicted in FIG. 5. In this case, the slopes (1) and (2) of the Formant filter characteristic are different in sign but equal in the angle of inclination as will be seen from FIG. 12A. The embodiment of FIG. 11 is intended to create a Formant filter characteristic the slopes of which are different in the angle of inclination as well as in sign, as indicated by (1') and (2') in FIG. 12B. The complementor 302-2, supplied with the address signal D and the control signal Co from the subtractor 302-1, generates address signals for the slope memories (I) and (II). The control signal Co is also applied, as a slope memory select signal, directly to the slope memory (I) 301-1 and via an inverter 111 to the slope memory (II) 301-2, selecting the former when $q \leqq q_c$ and the latter when $q \geqq q_c$. That is to say, in the case where the slope memories (I) 301-1 and (II) 301-2 have loaded therein the slopes (2') and (1'), respectively, the data selector 304 yields such an output as depicted in FIG. 12B. In this way, the Formant filter characteristic which has different slopes on both sides of the cut-off order $q_c$ can be obtained by adding one slope memory. While in the above the stored contents of the slope memories are straight slopes, it is also possible to produce various Formant filter characteristics by storing desired curves in the slope memories as described previously with respect to FIGS. 9 and 10.

Figure 13:
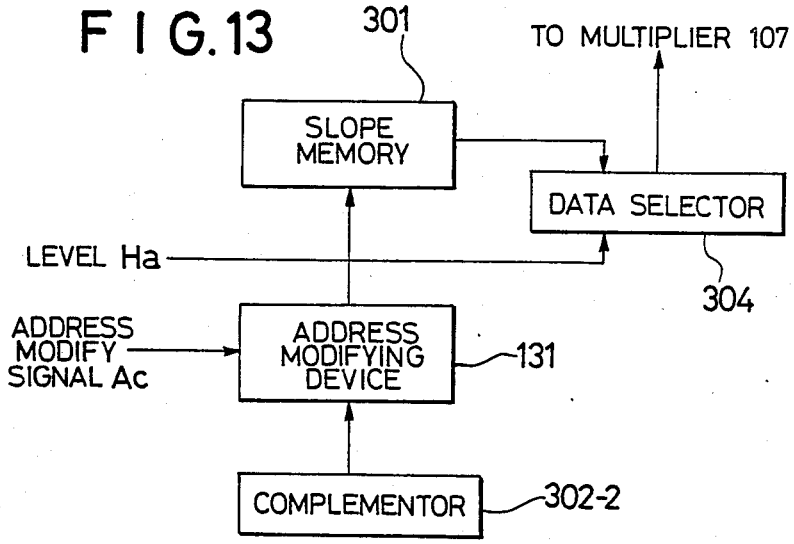
Figure 14:
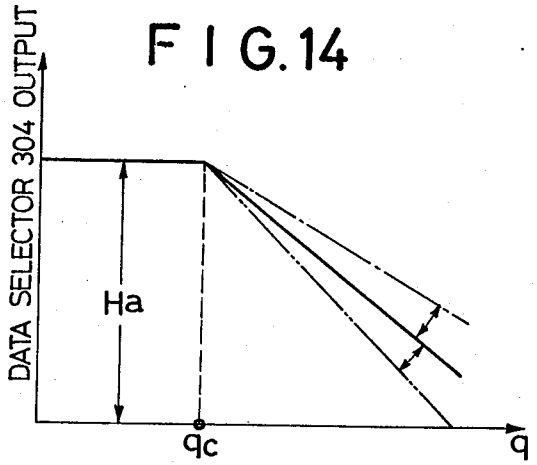

FIGS. 13 and 14 show another embodiment of the present invention in which the slope of the Formant filter characteristic can easily be changed by modifying the address signal for the slope memory 301. The address signal from the complementor 302-2 is provided to an address modifying device 131, wherein it is modified by an address modify signal Ac, the modified signal being applied as an address signal to the slope memory 301. Slope data of a desired inclination is read out of the slope memory 301 and supplied to the data selector 304. FIG. 14 shows the Formant filter characteristic when the level Ha from the data selector 304 is "1", that is, 0 dB and the cut-off order $q_c$ is set to a desired value. In FIG. 14, the full line shows the slope obtained when the address signal is not modified by the address modify signal Ac and the one-dot and two-dot chain line slopes when the address signal is modified by the address modify signal Ac. Thus, Formant filter characteristics of various slopes can easily be obtained by modifying the slope memory address signal.

As described above, according to the present invention intended for creating a desired musical waveform by combining harmonic components, each harmonic component value is controlled by selecting the cut-off order $q_c$, the level Ha and the slope value of the Formant filter characteristic. Furthermore, the cut-off order $q_c$, the level Ha and the slope value can each be varied over a predetermined range. Besides, these operations can be performed with a simple circuit arrangement involving a small number of memories. Hence the present invention permits the reduction of the size and the cost of the electronic musical instrument.

It will be apparent that many modifications and variations may be effected without departing from the scope of the novel concepts of the present invention.

What is claimed is:

1. An electronic musical instrument which combines harmonic components corresponding to respective harmonic orders into a desired musical waveform, the desired musical waveform having a formant filter characteristic with a harmonic order (q), a cutoff harmonic order ($q_c$) which is below or above the harmonic order, a level (Ha), and a slope (SL), comprising:

means for generating the cut-off harmonic order ($q_c$) of a formant filter characteristic;

means for generating the level (Ha) of the formant filter characteristic;

memory means for storing the slope (SL) of the formant filter characteristic at an address in the memory means;

means for generating the address for reading out the slope from the memory means on the basis of the cut-off harmonic order ($q_c$) and the harmonic order (q);

select means for selecting one of the level (Ha) from the level generating means and the slope from the memory means in accordance with the cut-off harmonic order ($q_c$), the select means generating a formant filter characteristic signal therefrom; and means for using the formant filter characteristic signal to set a component value for the harmonic order as a function of one of the levels and slope for the formant filter characteristic.

2. The electronic musical instrument of claim 1, wherein: the select means includes means whereby the output signal from the select means is provided with a high-pass Formant filter characteristic or low-pass Formant filter characteristic.

3. The electronic musical instrument or claim 1, wherein: the cut-off harmonic order ($q_c$) generating means includes means for varying the cut-off harmonic order ($q_c$).

4. The electronic musical instrument of claim 3, wherein: the cut-off harmonic order ($q_c$) varying means generates the cut-off harmonic order ($q_c$) which varies with envelope (ADSR) information from an envelope generator which generates an envelope the output amplitude of which varies with time, touch response information from a touch response information generator which defects the speed of a key depression and generates the touch response information in accordance with the detected speed, and tone information of a tone selected by a tablet switch.

5. The electronic musical instrument of claim 1, wherein: the level (Ha) generating means includes means for varying the level (Ha).

6. The electronic musical instrument of claim 5, wherein: the level (Ha) varying means generates the level (Ha) which varies with envelope (ADSR) information from an envelope generator which generates an envelope the output amplitude of which varies with time, touch response information from a touch response information generator which detects the speed of a key depression and generates the touch response information in accordance with the detected speed, and the tone information of a tone selected by a tablet switch.

7. The electronic musical instrument of claim 1, further comprising: means for changing the slope (SL) read out from the memory means, whereby the slope of the Formant filter characteristic is changed.

8. The electronic musical instrument of claim 7, wherein: the slope (SL) changing means includes means for comparing the harmonic order (q) with the cut-off harmonic order ($q_c$) and means whereby the slope of a region of the harmonic order (q) lower than the cut-off harmonic order ($q_c$) and the slope of a region of the harmonic order (q) higher than the cut-off harmonic order ($q_c$) are made different from each other, thereby changing the slope of the Formant filter characteristic.

9. The electronic musical instrument of claim 7, further comprising: means for changing the address from the address generating means for reading out the memory means, whereby changing the slope (SL) to be read out from the memory means to change the slope of the Formant filter characteristic.

* * * * *